US008703676B2

(12) United States Patent
Bertram et al.

(10) Patent No.: US 8,703,676 B2
(45) **Date of Patent: *Apr. 22, 2014**

(54) MARINE ENGINE LUBRICATION

(75) Inventors: Richard D. Bertram, Witney (GB); Peter J. Dowding, Wantage (GB); Joseph P. Hartley, Oxford (GB); Peter D. Watts, Abingdon (GB)

(73) Assignee: Infineum International Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/265,339

(22) PCT Filed: Apr. 26, 2010

(86) PCT No.: PCT/EP2010/002621

§ 371 (c)(1), (2), (4) Date: Oct. 20, 2011

(87) PCT Pub. No.: WO2010/124859

PCT Pub. Date: Nov. 4, 2010

(65) Prior Publication Data

US 2012/0034829 A1 Feb. 9, 2012

(30) Foreign Application Priority Data

May 1, 2009 (EP) ..... 09159278

(51) Int. Cl.

| | |
|---|---|
| ***C10M 159/22*** | (2006.01) |
| ***F01M 7/00*** | (2006.01) |
| ***F01M 9/10*** | (2006.01) |

(52) U.S. Cl.

USPC ..... 508/460; 123/196 R

(58) Field of Classification Search

None

See application file for complete search history.

(56) References Cited

U.S. PATENT DOCUMENTS

| | | | | |
|---|---|---|---|---|
| 2002/0183212 | A1* | 12/2002 | Hammond et al. | 508/460 |
| 2003/0004069 | A1 | 1/2003 | Hammond et al. | |
| 2007/0027043 | A1 | 2/2007 | Le Coent | |
| 2007/0117726 | A1 | 5/2007 | Cartwright | |
| 2008/0274922 | A1* | 11/2008 | Yagishita | 508/382 |

FOREIGN PATENT DOCUMENTS

| | | | |
|---|---|---|---|
| EP | 1191088 | B1 | 3/2006 |
| WO | WO-96/26995 | A1 | 9/1996 |
| WO | WO-2008/128656 | A2 | 10/2008 |
| WO | WO-2008/128657 | A2 | 10/2008 |

* cited by examiner

*Primary Examiner* — Ellen M McAvoy
*Assistant Examiner* — Vishal Vasisth

(57) ABSTRACT

Trunk piston marine engine lubrication, when the engine is fueled by heavy fuel oil, is effected by a composition comprising a major amount of an oil of lubricating viscosity containing at least 50 mass % of a Group II basestock, and respective minor amounts of an overbased metal hydrocarbyl-substituted hydroxybenzoate detergent other than such a detergent having a basicity index of less than two and a degree of carbonation of 80% or greater and 5 to 500 mass %, based on the mass of the detergent, of an oil-soluble alkyl-substituted phenol other than a hindered phenol. Asphaltene precipitation in the lubricant, caused by the presence of contaminant heavy fuel oil, is prevented or inhibited.

10 Claims, No Drawings

MARINE ENGINE LUBRICATION

This application is a 371 of PCT/EP10/02621, filed Apr. 26, 2010.

FIELD OF THE INVENTION

This invention relates to a trunk piston marine engine lubricating composition for a medium-speed four-stroke compression-ignited (diesel) marine engine and lubrication of such an engine.

BACKGROUND OF THE INVENTION

Marine trunk piston engines generally use Heavy Fuel Oil ('HFO') for offshore running. Heavy Fuel Oil is the heaviest fraction of petroleum distillate and comprises a complex mixture of molecules including up to 15% of asphaltenes, defined as the fraction of petroleum distillate that is insoluble in an excess of aliphatic hydrocarbon (e.g. heptane) but which is soluble in aromatic solvents (e.g. toluene). Asphaltenes can enter the engine lubricant as contaminants either via the cylinder or the fuel pumps and injectors, and asphaltene precipitation can then occur, manifested in 'black paint' or 'black sludge' in the engine. The presence of such carbonaceous deposits on a piston surface can act as an insulating layer which can result in the formation of cracks that then propagate through the piston. If a crack travels through the piston, hot combustion gases can enter the crankcase, possibly resulting in a crankcase explosion.

It is therefore highly desirable that trunk piston engine oils ('TPEO's) prevent or inhibit asphaltene precipitation. The prior art describes ways of doing this.

WO 96/26995 discloses the use of a hydrocarbyl-substituted phenol to reduce 'black paint' in a diesel engine. WO 96/26996 discloses the use of a demulsifier for water-in-oil emulsions, for example, a polyoxyalkylene polyol, to reduce 'black paint' in diesel engines. U.S. Pat. No. 7,053,027 describes use of one or more overbased metal carboxylate detergents in combination with an antiwear additive in a dispersant-free TPEO.

The problem of asphaltene precipitation is more acute at higher basestock saturate levels. WO 2008/128656 describes a solution by use of an overbased metal hydrocarbyl-substituted hydroxybenzoate detergent having a basicity index of less than 2 and a degree of carbonation of 80% or greater in a marine trunk piston engine lubricant to reduce asphaltene precipitation in the lubricant. Exemplified are lubricants comprising a Group II basestock, which has a higher basestock saturate level than a Group I basestock.

The above-described solution is however restricted to a specific class of detergents. It is now found, in the present invention, that the problem in WO 2008/128656 is solved for a different range of overbased metal carboxylate detergents by employing, in combination therewith, an alkyl-substituted phenol other than a hindered phenol.

SUMMARY OF THE INVENTION

A first aspect of the invention is a trunk piston marine engine lubricating oil composition for improving asphaltene handling in use thereof, in operation of the engine when fuelled by a heavy fuel oil, which composition comprises or is made by admixing an oil of lubricating viscosity, in a major amount, containing 50 mass % or more of a Group II basestock, and, in respective minor amounts:

(A) an overbased metal hydrocarbyl-substituted hydroxybenzoate detergent other than such a detergent having a basicity index of less than two and a degree of carbonation of 80% or greater, where degree of carbonation is the percentage of carbonate present in the overbased metal hydrocarbyl-substituted hydroxybenzoate detergent expressed as a mole percentage relative to the total excess base in the detergent; and (B) 5 to 500, preferably 15 to 90, mass % active ingredient, based on the active ingredient mass of (A), of an oil-soluble alkyl-substituted phenol other than a hindered phenol.

A second aspect of the invention is the use of a detergent (A) in combination with a component (B) as defined in, and in the amounts stated in, the first aspect of the invention in a trunk piston marine lubricating oil composition for a medium-speed compression-ignited marine engine, which composition comprises an oil of lubricating viscosity in a major amount and contains 50 mass % or more of a Group II basestock, to improve asphaltene handling during operation of the engine, fueled by a heavy fuel oil, and its lubrication by the composition, in comparison with analogous operation when the same amount of detergent (A) is used in the absence of (B).

A third aspect of the invention is a method of operating a trunk piston medium-speed compression-ignited marine engine comprising (i) fueling the engine with a heavy fuel oil; and (ii) lubricating the crankcase of the engine with a composition as defined in the first aspect of the invention.

A fourth aspect of the invention is a method of dispersing asphaltenes in a trunk piston marine lubricating oil composition during its lubrication of surfaces of the combustion chamber of a medium-speed compression-ignited marine engine and operation of the engine, which method comprises (i) providing a composition as defined in the first aspect of the invention;

(ii) providing the composition in the combustion chamber;

(iii) providing heavy fuel oil in the combustion chamber; and (iv) combusting the heavy fuel oil in the combustion chamber.

In this specification, the following words and expressions, if and when used, have the meanings ascribed below:

"active ingredients" or "(a.i.)" refers to additive material that is not diluent or solvent;

"comprising" or any cognate word specifies the presence of stated features, steps, or integers or components, but does not preclude the presence or addition of one or more other features, steps, integers, components or groups thereof; the expressions "consists of" or "consists essentially of" or cognates may be embraced within "comprises" or cognates, wherein "consists essentially of" permits inclusion of substances not materially affecting the characteristics of the composition to which it applies;

"major amount" means in excess of 50 mass % of a composition;

"minor amount" means less than 50 mass % of a composition;

"TBN" means total base number as measured by ASTM D2896.

Furthermore in this specification:

"calcium content" is as measured by ASTM 4951;

"phosphorus content" is as measured by ASTM D5185;

"sulphated ash content" is as measured by ASTM D874;

"sulphur content" is as measured by ASTM D2622;

"KV100" means kinematic viscosity at 100° C. as measured by ASTM D445.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

DETAILED DESCRIPTION OF THE INVENTION

The features of the invention will now be discussed in more detail below.

Oil of Lubricating Viscosity

The lubricating oils may range in viscosity from light distillate mineral oils to heavy lubricating oils. Generally, the viscosity of the oil ranges from 2 to 40 $mm^2$/sec, as measured at 100° C.

Natural oils include animal oils and vegetable oils (e.g., caster oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkybenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulphides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

Unrefined, refined and re-refined oils can be used in lubricants of the present invention. Unrefined oils are those obtained directly from a natural or synthetic source without further purification treatment. For example, a shale oil obtained directly from retorting operations; petroleum oil obtained directly from distillation; or ester oil obtained directly from an esterification and used without further treatment would be an unrefined oil. Refined oils are similar to unrefined oils except that the oil is further treated in one or more purification steps to improve one or more properties. Many such purification techniques, such as distillation, solvent extraction, acid or base extraction, filtration and percolation are known to those skilled in the art. Re-refined oils are obtained by processes similar to those used to provide refined oils but begin with oil that has already been used in service. Such re-refined oils are also known as reclaimed or reprocessed oils and are often subjected to additional processing using techniques for removing spent additives and oil breakdown products.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulphur and have a viscosity index greater than or equal to 80 and less than 120 using the test methods specified in Table E-1.
b) Group II base stocks contain greater than or equal to 90 percent saturates and less than or equal to 0.03 percent sulphur and have a viscosity index greater than or equal to 80 and less than 120 using the test methods specified in Table E-1.
c) Group III base stocks contain greater than or equal to 90 percent saturates and less than or equal to 0.03 percent sulphur and have a viscosity index greater than or equal to 120 using the test methods specified in Table E-1.
d) Group IV base stocks are polyalphaolefins (PAO).
e) Group V base stocks include all other base stocks not included in Group I, II, III, or IV.

Analytical Methods for Base Stock are tabulated below:

| PROPERTY | TEST METHOD |
|---|---|
| Saturates | ASTM D 2007 |
| Viscosity Index | ASTM D 2270 |
| Sulphur | ASTM D 2622 |
| | ASTM D 4294 |
| | ASTM D 4927 |
| | ASTM D 3120 |

As stated, the oil of lubricating viscosity in this invention contains 50 mass % or more of a Group II basestock. Preferably, it contains 60, such as 70, 80 or 90, mass % or more of a Group II basestock. The oil of lubricating viscosity may be substantially all Group II basestock.

Overbased Metal Detergent (A)

A metal detergent is an additive based on so-called metal "soaps", that is metal salts of acidic organic compounds, sometimes referred to as surfactants. They generally comprise a polar head with a long hydrophobic tail. Overbased metal detergents, which comprise neutralized metal detergents as the outer layer of a metal base (e.g. carbonate) micelle, may be provided by including large amounts of metal base by reacting an excess of a metal base, such as an oxide or hydroxide, with an acidic gas such as carbon dioxide.

In the present invention, overbased metal detergents (A) are overbased metal hydrocarbyl-substituted hydroxybenzoate, preferably hydrocarbyl-substituted salicylate, detergents.

"Hydrocarbyl" means a group or radical that contains carbon and hydrogen atoms and that is bonded to the remainder of the molecule via a carbon atom. It may contain hetero atoms, i.e. atoms other than carbon and hydrogen, provided they do not alter the essentially hydrocarbon nature and characteristics of the group. As examples of hydrocarbyl, there may be mentioned alkyl and alkenyl. The overbased metal hydrocarbyl-substituted hydroxybenzoate typically has the structure shown:

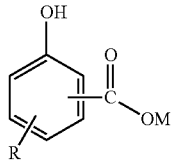

wherein R is a linear or branched aliphatic hydrocarbyl group, and more preferably an alkyl group, including straight- or branched-chain alkyl groups. There may be more than one R group attached to the benzene ring. M is an alkali metal (e.g. lithium, sodium or potassium) or alkaline earth metal (e.g. calcium, magnesium barium or strontium). Calcium or magnesium is preferred; calcium is especially preferred. The COOM group can be in the ortho, meta or para position with respect to the hydroxyl group; the ortho position is preferred. The R group can be in the ortho, meta or para position with respect to the hydroxyl group.

Hydroxybenzoic acids are typically prepared by the carboxylation, by the Kolbe-Schmitt process, of phenoxides, and in that case, will generally be obtained (normally in a diluent) in admixture with uncarboxylated phenol. Hydroxybenzoic acids may be non-sulphurized or sulphurized, and may be chemically modified and/or contain additional substituents. Processes for sulphurizing a hydrocarbyl-substituted hydroxybenzoic acid are well known to those skilled in the art, and are described, for example, in US 2007/0027057.

In hydrocarbyl-substituted hydroxybenzoic acids, the hydrocarbyl group is preferably alkyl (including straight- or branched-chain alkyl groups), and the alkyl groups advantageously contain 5 to 100, preferably 9 to 30, especially 14 to 24, carbon atoms.

The term "overbased" is generally used to describe metal detergents in which the ratio of the number of equivalents of the metal moiety to the number of equivalents of the acid moiety is greater than one. The term 'low-based' is used to describe metal detergents in which the equivalent ratio of metal moiety to acid moiety is greater than 1, and up to about 2.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Carbonated overbased metal detergents typically comprise amorphous nanoparticles. Additionally, there are disclosures of nanoparticulate materials comprising carbonate in the crystalline calcite and vaterite forms.

The basicity of the detergents may be expressed as a total base number (TBN). A total base number is the amount of acid needed to neutralize all of the basicity of the overbased material. The TBN may be measured using ASTM standard D2896 or an equivalent procedure. The detergent may have a low TBN (i.e. a TBN of less than 50), a medium TBN (i.e. a TBN of 50 to 150) or a high TBN (i.e. a TBN of greater than 150, such as 150-500). In this invention, Basicity Index and Degree of Carbonation may be used. Basicity Index is the molar ratio of total base to total soap in the overbased detergent. Degree of Carbonation is the percentage of carbonate present in the overbased detergent expressed as a mole percentage relative to the total excess base in the detergent.

Overbased metal hydrocarbyl-substituted hydroxybenzoates can be prepared by any of the techniques employed in the art. A general method is as follows:

1. Neutralisation of hydrocarbyl-substituted hydroxybenzoic acid with a molar excess of metallic base to produce a slightly overbased metal hydrocarbyl-substituted hydroxybenzoate complex, in a solvent mixture consisting of a volatile hydrocarbon, an alcohol and water;
2. Carbonation to produce colloidally-dispersed metal carbonate followed by a post-reaction period;
3. Removal of residual solids that are not colloidally dispersed; and
4. Stripping to remove process solvents.

Overbased metal hydrocarbyl-substituted hydroxybenzoates can be made by either a batch or a continuous overbasing process.

Metal base (e.g. metal hydroxide, metal oxide or metal alkoxide), preferably lime (calcium hydroxide), may be charged in one or more stages. The charges may be equal or may differ, as may the carbon dioxide charges which follow them. When adding a further calcium hydroxide charge, the carbon dioxide treatment of the previous stage need not be complete. As carbonation proceeds, dissolved hydroxide is converted into colloidal carbonate particles dispersed in the mixture of volatile hydrocarbon solvent and non-volatile hydrocarbon oil.

Carbonation may by effected in one or more stages over a range of temperatures up to the reflux temperature of the alcohol promoters. Addition temperatures may be similar, or different, or may vary during each addition stage. Phases in which temperatures are raised, and optionally then reduced, may precede further carbonation steps.

The volatile hydrocarbon solvent of the reaction mixture is preferably a normally liquid aromatic hydrocarbon having a boiling point not greater than about 150° C. Aromatic hydrocarbons have been found to offer certain benefits, e.g.

improved filtration rates, and examples of suitable solvents are toluene, xylene, and ethyl benzene.

The alkanol is preferably methanol although other alcohols such as ethanol can be used. Correct choice of the ratio of alkanol to hydrocarbon solvents, and the water content of the initial reaction mixture, are important to obtain the desired product.

Oil may be added to the reaction mixture; if so, suitable oils include hydrocarbon oils, particularly those of mineral origin. Oils which have viscosities of 15 to 30 $mm^2$/sec at 38° C. are very suitable.

After the final treatment with carbon dioxide, the reaction mixture is typically heated to an elevated temperature, e.g. above 130° C., to remove volatile materials (water and any remaining alkanol and hydrocarbon solvent). When the synthesis is complete, the raw product is hazy as a result of the presence of suspended sediments. It is clarified by, for example, filtration or centrifugation. These measures may be used before, or at an intermediate point, or after solvent removal.

The products are generally used as an oil solution. If the reaction mixture contains insufficient oil to retain an oil solution after removal of the volatiles, further oil should be added. This may occur before, or at an intermediate point, or after solvent removal.

In this invention, (A) may have:

(A1) a basicity index of two or greater and a degree of carbonation of 80% or greater; or (A2) a basicity index of two or greater and a degree of carbonation of less than 80%; or (A3) a basicity index of less than two and a degree of carbonation of less than 80%.

Alky-Substituted Phenol (B)

As stated, the phenol constitutes 5 to 500, preferably 15 to 90, mass % of the mass of (A). More preferably it constitutes from 20 to 80, such as 30 to 70, for example 40 to 60, mass %.

The alkyl substituent in (B) may for example be a straight chain or branched, preferably a straight chain, single alkyl group having from 9 to 30, preferably 14 to 24, carbon atoms.

As an example of alkylphenol (B) there may be mentioned an alkyl benzenol where the alkyl substitution is, for example, in the 2-position or in the 4-position.

As a further example of alkylphenol (B) there may be mentioned an alkylnaphthol where the alkyl substitution is in the 1-position or in the 2-position.

As a further example of alkylphenol (B) there may be mentioned an alkyl phenol aldehyde condensate, preferably where the aldehyde is formaldehyde such that the condensate is a methylene-bridged alkylphenol. Examples of such condensates are known in the art such as in EP-A-1 657 292.

The treat rate of additives (A) and (B) contained in the lubricating oil composition may for example be in the range of 1 to 25, preferably 2 to 20, more preferably 5 to 18, mass %.

(A) and (B) may be provided together for the purpose of the invention by blending them together. Or, they may be provided together during the manufacture of (A) by incorporating (B) during the overbasing step to manufacture (A).

Co-Additives

The lubricating oil composition of the invention may comprise further additives, different from and additional to (A) and (B). Such additional additives may, for example include ashless dispersants, other metal detergents, anti-wear agents such as zinc dihydrocarbyl dithiophosphates, anti-oxidants and demulsifiers.

It may be desirable, although not essential, to prepare one or more additive packages or concentrates comprising the additives, whereby additives (A) and (B) can be added simultaneously to the base oil to form the lubricating oil composition. Dissolution of the additive package(s) into the lubricating oil may be facilitated by solvents and by mixing accompanied with mild heating, but this is not essential. The additive package(s) will typically be formulated to contain the additive(s) in proper amounts to provide the desired concentration, and/or to carry out the intended function in the final formulation when the additive package(s) is/are combined with a predetermined amount of base lubricant. Thus, additives (A) and (B), in accordance with the present invention, may be admixed with small amounts of base oil or other compatible solvents together with other desirable additives to form additive packages containing active ingredients in an amount, based on the additive package, of, for example, from 2.5 to 90, preferably from 5 to 75, most preferably from 8 to 60, mass % of additives in the appropriate proportions, the remainder being base oil.

The final formulations as a trunk piston engine oil may typically contain 30, preferably 10 to 28, more preferably 12 to 24, mass % of the additive package(s), the remainder being base oil. Preferably, the trunk piston engine oil has a compositional TBN (using ASTM D2896) of 20 to 60, such as 25 to 55.

EXAMPLES

The present invention is illustrated by but in no way limited to the following examples.

Components

The following components were used:

Component (A):

(A1)) a calcium salicylate detergent having a TBN of 350 (basicity index of two or greater; a degree of carbonation of 80% or greater) and containing 6 mass % of alkylphenol;

(A2) a calcium salicylate detergent having a TBN of 225 (basicity index of two or greater; a degree of carbonation of less than 80%) and containing 5 mass % of alkylphenol;

(A3) a calcium salicylate detergent having a TBN of 65 (basicity index of less than two; a degree of carbonation of less than 80%) and containing 8 mass % of alkylphenol.

(A3) and (B) a calcium salicylate detergent having a TBN of 67 (basicity index of less than two; a degree of carbonation of less than 80%), overbased in the presence of phenol B1 (see below). Two different products were made as indicated in TABLE 1 below.

Component (B):

(B1) a mixed 2- and 4-(linear C16 alkyl)benzenol (2:1)

(B2) a 1-(linear C16 alkyl) naphthol (B3) a 2-(linear C16 alkyl) naphthol.

Base oil I: an API Group I base oil known as XOMAPE600

Base oil II: an API Group II base oil known as CHEV600R

HFO: a heavy fuel oil, ISO—F-RMK 380

Lubricants

Selections of the above components were blended to give a range of trunk piston marine engine lubricants. Some of the lubricants are examples of the invention; others are reference examples for comparison purposes. The compositions of the lubricants tested when each contained HFO are shown in the tables below under the "Results" heading.

Testing

Light Scattering

Test lubricants were evaluated for asphaltene dispersancy using light scattering according to the Focused Beam Reflectance Method ("FBRM"), which predicts asphaltene agglomeration and hence 'black sludge' formation.

The FBRM test method was disclosed at the 7th International Symposium on Marine Engineering, Tokyo, 24th-28 Oct. 2005, and was published in 'The Benefits of Salicylate Detergents in TPEO Applications with a Variety of Base Stocks', in the Conference Proceedings. Further details were disclosed at the CIMAC Congress, Vienna, 21-24 May 2007 and published in "Meeting the Challenge of New Base Fluids for the Lubrication of Medium Speed Marine Engines—An Additive Approach" in the Congress Proceedings. In the latter paper it is disclosed that by using the FBRM method it is possible to obtain quantitative results for asphaltene dispersancy that predict performance for lubricant systems based on basestocks containing greater than or less than 90% saturates, and greater than or less than 0.03% sulphur. The predictions of relative performance obtained from FBRM were confirmed by engine tests in marine diesel engines.

The FBRM probe contains fibre optic cables through which laser light travels to reach the probe tip. At the tip, an optic focuses the laser light to a small spot. The optic is rotated so that the focussed beam scans a circular path between the window of the probe and the sample. As particles flow past the window they intersect the scanning path, giving backscattered light from the individual particles.

The scanning laser beam travels much faster than the particles; this means that the particles are effectively stationary. As the focussed beam reaches one edge of the particle there is an increase in the amount of backscattered light; the amount will decrease when the focussed beam reaches the other edge of the particle.

The instrument measures the time of the increased backscatter. The time period of backscatter from one particle is multiplied by the scan speed and the result is a distance or chord length. A chord length is a straight line between any two points on the edge of a particle. This is represented as a chord length distribution, a graph of numbers of chord lengths (particles) measured as a function of the chord length dimensions in microns. As the measurements are performed in real time the statistics of a distribution can be calculated and tracked. FBRM typically measures tens of thousands of chords per second, resulting in a robust number-by-chord length distribution. The method gives an absolute measure of the particle size distribution of the asphaltene particles.

The Focused beam Reflectance Probe (FBRM), model Lasentec D600L, was supplied by Mettler Toledo, Leicester, UK. The instrument was used in a configuration to give a particle size resolution of 1 μm to 1 mm. Data from FBRM can be presented in several ways. Studies have suggested that the average counts per second can be used as a quantitative determination of asphaltene dispersancy. This value is a function of both the average size and level of agglomerate. In this application, the average count rate (over the entire size range) was monitored using a measurement time of 1 second per sample.

The test lubricant formulations were heated to 60° C. and stirred at 400 rpm; when the temperature reached 60° C. the FBRM probe was inserted into the sample and measurements made for 15 minutes. An aliquot of heavy fuel oil (10% w/w) was introduced into the lubricant formulation under stirring using a four blade stirrer (at 400 rpm). A value for the average counts per second was taken when the count rate had reached an equilibrium value (typically overnight).

Results

Light Scattering

The results of the FBRM tests are summarized in TABLES 1 and 2 below. In TABLE 1, phenol B1 was incorporated into Ca salicylate during the overbasing step to produce (A3)+(B).

In TABLE 2, phenols B1, B2 and B3 were each blended separately with overbased Ca salicylate (A1).

The base oil was Base oil II.

All values in each table are mass % a.i. other than the particle count values in the right hand column. Comparative examples are designated "Ref" and examples of the invention designated "In".

TABLE 1

| Ex | Salicylic acid | Phenol | Salicylic acid & Phenol | Particle counts |
|---|---|---|---|---|
| Ref 1 | 0 | 0 | 0 | 6000 |
| Ref 2 | 0 | 4.0 | 4.0 | 4800 |
| Ref 3 | 3.1 | 0.3 | 3.4 | 400 |
| In 3 | 0.7 | 2.1 | 2.8 | 500 |
| Ref 4 | 15.6 | 1.3 | 16.9 | 10 |
| In 4 | 3.5 | 10.7 | 14.2 | 10 |

In 3 and In 4 each contain the same additive but at different treat rates. Likewise, Examples Ref 3 and Ref 4 each contain the same additive but at different treat rates.

Ref 2 shows that the phenol alone gave a very poor performance. Ref 3 shows that salicylate alone (with a small amount of inherent phenol) has a better performance. In 3 shows that, even when a much higher percentage of phenol is used, the performance remains much the same. (The expectation would be that the relative higher phenol content would severely diminish performance). Ref 4 and In 4 illustrate the same point at higher concentrations.

TABLE 2

| Ex | Salicylic acid | Phenol | Salicylic acid & Phenol | Particle counts |
|---|---|---|---|---|
| Ref 1 | 0 | 0 | 0 | 6000 |
| Ref 2 | 0 | 4.0 (B1) | 4.0 | 4800 |
| Ref 5 | 8.0 | 0.8 | 8.8 | 2100 |
| In 5 | 8.0 | 2.0 (B1) | 10.0 | 900 |
| In 6 | 8.0 | 4.0 (B1) | 12.0 | 700 |
| Ref 7 | 0 | 4.4 (B2) | 4.4 | 8700 |
| In 7 | 8.0 | 4.4 (B2) | 12.4 | 1100 |
| Ref 8 | 0 | 4.4 (B3) | 4.4 | 5800 |
| In 8 | 8.0 | 4.4 (B3) | 12.4 | 1000 |

Results for In 5 and In 6 show that, as phenol B1 is added, performance improves over Ref 5. This is very surprising in view of the performance of B1 alone in Ref 2.

Results for In 7 and In 8 show the same surprising improvement for phenols B2 and B3 respectively given the very poor performance of B2 and B3 alone in Ref 7 and Ref 8 respectively.

The invention claimed is:

1. A trunk piston marine engine lubricating oil composition for improving asphaltene handling in use thereof, in operation of the engine when fuelled by a heavy fuel oil, which composition has a TBN of from 20 to 60 mg KOH/g and comprises or is made by admixing an oil of lubricating viscosity, in a major amount, containing 50 mass % or more of a Group II basestock, and, in respective minor amounts:

(A) an overbased metal hydrocarbyl-substituted hydroxybenzoate detergent having a basicity index of two or greater; and (B) 5 to 500 mass % active ingredient, based on the active ingredient mass of (A) of an oil-soluble alkyl-substituted phenol other than a hindered phenol, said oil-soluble alkyl-substituted phenol being selected from the group consisting of alkylbenzenols having a single alkyl group substituent having 9 to 30 atoms in the 2-position or in the 4-position, and alkylnaphthols having a single alkyl group substituent having 9 to 30 atoms in the 1-position or in the 2-position.

2. The composition as claimed in claim 1 wherein (B) is an alkylbenzenol.

3. The composition as claimed in claim 1 wherein (B) is an alkylnaphthol.

4. The composition as claimed in claim 1 wherein (B) is provided in (A) during the overbasing step in the manufacture of (A).

5. The composition as claimed in claim 1 wherein (B) is blended separately with (A).

6. The composition as claimed in claim 1 wherein the metal in (A) is calcium.

7. The composition as claimed in claim 1 wherein the hydrocarbyl-substituted hydroxybenzoate in (A) is a salicylate.

8. The composition as claimed in claim 1 wherein the oil of lubricating viscosity contains more than 60 mass % of a Group II basestock.

9. A method of operating a trunk piston medium-speed compression-ignited marine engine comprising (i) fueling the engine with a heavy fuel oil; and (ii) lubricating the crankcase of the engine with a composition as defined in claim 1.

10. A method of dispersing asphaltenes in a trunk piston marine lubricating oil composition during its lubrication of surfaces of the combustion chamber of a medium-speed compression-ignited marine engine and operation of the engine, which method comprises (i) providing a composition as defined in claim 1:

(ii) providing the composition in the combustion chamber;

(iii) providing heavy fuel oil in the combustion chamber; and (iv) combusting the heavy fuel oil in the combustion chamber.

* * * * *